United States Patent [19]

Fischer

[11] 3,946,515

[45] Mar. 30, 1976

[54] CHAIN HAVING DETACHABLE LINKS AND BUCKETS

[76] Inventor: Artur Fischer, Altheimer Strasse 219, D-7241 Tumlingen, Germany

[22] Filed: Mar. 19, 1974

[21] Appl. No.: 452,998

[30] Foreign Application Priority Data

Mar. 23, 1973 Germany ..... 7311025
Apr. 10, 1973 Germany ..... 7313486

[52] U.S. Cl. ..... 46/17; 59/78; 59/DIG. 1; 198/140

[51] Int. Cl.[2] ..... A63H 33/08

[58] Field of Search ..... 46/17, 16, 23; 198/140; 59/90, 91, DIG. 1, 78

[56] References Cited

UNITED STATES PATENTS

| | | | |
|---|---|---|---|
| 1,473,258 | 11/1923 | Steedsman et al. | 198/140 X |
| 1,820,609 | 8/1931 | Erikson | 198/140 X |
| 2,303,294 | 11/1942 | Wagner | 46/17 UX |
| 3,451,158 | 6/1969 | Fischer | 46/23 X |
| 3,535,817 | 10/1970 | Fischer | 46/17 |

FOREIGN PATENTS OR APPLICATIONS

| | | | |
|---|---|---|---|
| 1,150,921 | 6/1963 | Germany | 198/140 |

*Primary Examiner*—F. Barry Shay
*Attorney, Agent, or Firm*—Michael J. Striker

[57] ABSTRACT

Toy elements are connected with sprocket chain elements by mutually cooperating connecting means, in form of undercut keys and of correspondingly shaped, undercut grooves. Each toy element has at least one of said connecting means, while at least some of said chain elements have the cooperating connecting means. The elements of the chain detachably connect with each other. The toy elements may be tread members or bucket members, and the latter may be connectable to the sprocket chain in two different positions.

10 Claims, 6 Drawing Figures

FIG.1
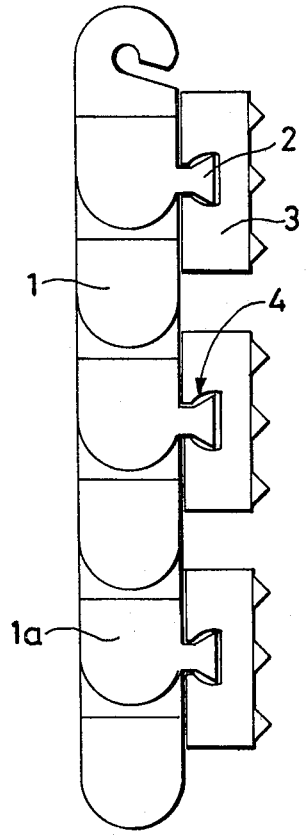
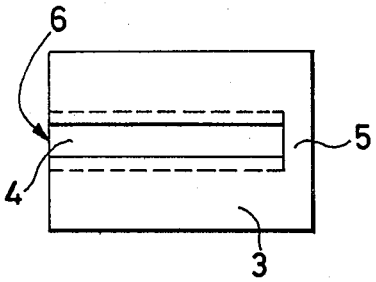
FIG. 1a
FIG.2
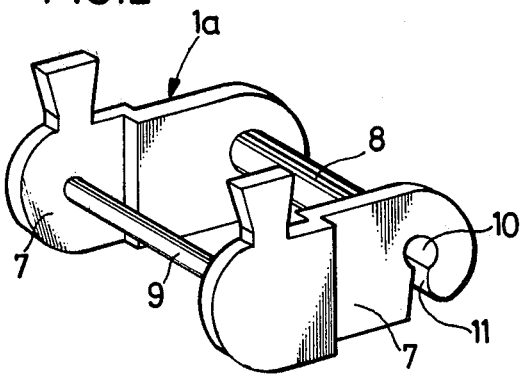

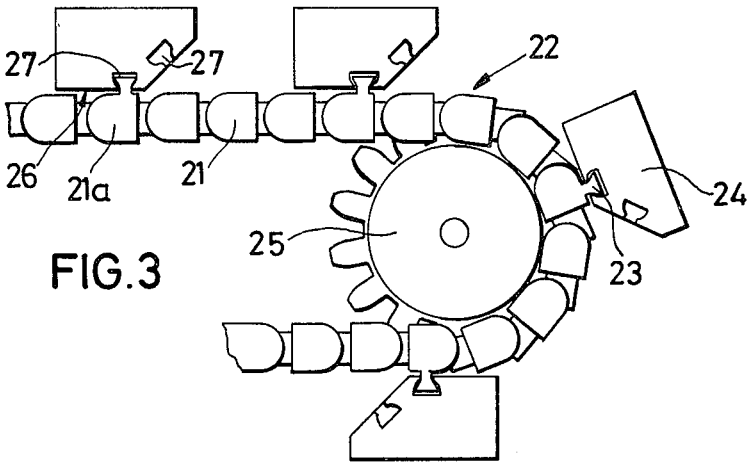
FIG.3
FIG.5
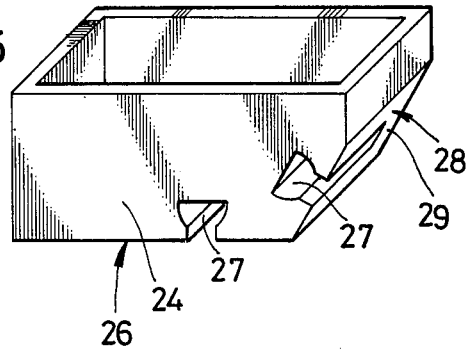
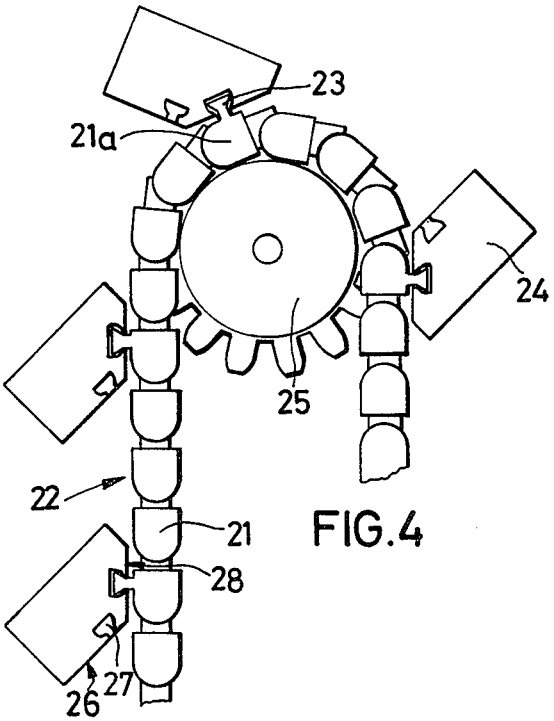
FIG.4

CHAIN HAVING DETACHABLE LINKS AND BUCKETS

BACKGROUND OF THE INVENTION

The invention relates to toys of the type including interconnectable chain links. It has been proposed heretofore to form such chain links so that the playing child can learn to build certain types of apparatus, for example to connect a drive sprocket by a chain with a driven sprocket; or to convey material in toy buckets attached to chain links; or to attach treads to chain links for building toy full-track vehicles and the like.

For assembling such buckets or treads or other toy elements to the chain links it is desirable to facilitate the attaching of the toy elements and also to insure proper mutual orientation of the elements when they are interconnected. In this latter aspect, difficulties have been encountered in the past.

SUMMARY OF THE INVENTION

It is an object of the invention to provide a new and improved toy unit.

It is another object to avoid the difficulties encountered in the past in toys of the types mentioned above.

A further object is to enable the playing child to interconnect the toy elements with the chain elements by simple manipulation, without the use of special tools; at the same time to insure proper interconnection of the various parts; to orient them properly relative to one another; and to maintain proper orientation of the parts in the operation of the toy.

According to the invention the objects are achieved by providing toy elements and chain elements with means for interconnecting these elements by undercut keys, which fit into correspondingly formed, undercut grooves, each of said toy elements being provided with at least one of said connecting means, and at least some of said chain elements being provided with the cooperating connecting means, so as to properly space the toy elements and to allow proper operation of the toy elements.

In particular, the connecting keys can be formed on chain links and the connecting grooves can be formed in toy blocks, and it is preferred to form the complete toy of toy links with keys on some of them and of toy blocks with at least one connecting groove in all of them.

The keys and grooves advantageously have shapes corresponding substantially to one another and providing close fit in one another. For this purpose it is desirable to make the elements of synthetic plastic material which allows slight resilient deformation when interconnecting the chain elements with the toy elements, so that, when the keys have been inserted in the grooves, they are normally held therein by friction.

The toy elements typically include buckets for a toy bucket chain. In order to enable the playing and learning child to mount said buckets on the chain in properly oriented condition, it is preferred to close one end of each connecting groove by a wall, integral with the toy element.

By means of these provisions the child can learn to construct a very adequate model of a bucket chain, full-track vehicle and the like. The child can also learn to keep the model in proper condition, during operation thereof. All this can be done without any special tools.

It is possible, for example, in the construction of a tread chain according to the invention, to provide the treads on the chain with groove closing walls on alternate sides of the chain, thus minimizing the danger that tread members are lost by sliding off, for example when a toy vehicle equipped with the treads is moved around a curve of small radius.

In order to make it particularly simple for a child to insert the connecting key into the matching groove, it is possible to shape the groove so that one end thereof has slight outward flare, thereby facilitating the introduction of the interconnecting key.

It is also possible and sometimes preferred to form the toy elements with a plurality of exposed surfaces each having connecting means, and particularly to form toy blocks with several connecting grooves, in surfaces which are advantageously arranged at an obtuse angle to one another to allow different orientations of the toy block relative to the chain.

The chain links are advantageously of the type having first side wall portions relatively close to one another and having second side wall portions more widely spaced; each link having a first rod between the first side wall portions and a second rod between the second side wall portions, with a bore and a groove formed in the second rod to allow snapping in of the first rod of a further chain link. In this case it is particularly advantageous to form the interconnecting keys on the second side wall portions, for firm and stable interconnection of the chain links and toy blocks.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a side view of a toy in accordance with the present invention;

FIG. 1*a* shows one of the toy elements in a view taken at right angles to this side view;

FIG. 2 is a perspective view of a chain element, used in the toy of FIG. 1;

FIG. 3 is a side view of another toy according to the invention;

FIG. 4 is a side view of this other toy, in a different arrangement; and

FIG. 5 is a perspective view of a toy element of the type used in FIGS. 3 and 4.

DESCRIPTION OF THE PREFERRED EMBODIMENTS

FIG. 1 shows chain 1 comprising interconnected chain links 1*a* connected to toy elements 3. The new chain links 1*a* have uniform length, are uniformly interconnectable to form chain 1, and have keys 2 of undercut shape, extending from the links in the plane of the chain, to provide for the attachment of toy blocks or toy elements, for example of tread members 3 for use on a full track vehicle, such as a toy version of an armored tank. For such connection tread means 3 has an undercut groove 4 of such shape that keys 2 fit into the groove. As shown in FIG. 1*a*, groove 4 extends across toy block 3 from one side thereof towards the other, and is closed at said other side by an end wall 5. This closing of the connection groove 4 facilitates the assembling of the full track tread chain by the playing child, while it assures proper mutual orientation of the tread members 3. In order to further facilitate such assembling, the open end 6 of groove 4, opposite to end wall 5, can be slightly widened to make sure that the keys 2 can be inserted therein without difficulty. As clearly shown in FIG. 1, the surfaces of toy element 3 defining the grooves 4 have contact with the wide ends of undercut keys 2, thereby providing sliding friction between these keys 2 and the toy elements 3 for holding the toy elements 3 on the chain 1. It will be understood that, by forming links 1*a* or treads 3, or preferably both, of synthetic plastic material, having suitable resiliency, the new construction facilitates both the assembling of the toy elements 3 with the chain links 1*a* and the holding of the toy elements 3 on the chain links 1*a*.

An individual chain link 1*a* for mounting a toy element thereon is shown in FIG. 2. It comprises wall means 7 comprised of first and second side wall portions. The wall means 7 is offset in a middle portion thereof to arrange the first side wall portions at one end of the chain link 1*a* relatively close together, while the second side wall portions at the other end of the chain link 1*a* is more widely spaced apart. The relatively close first side wall portions are laterally interconnected by a short rod 8, while the more widely spaced second side wall portions are interconnected by a longer rod 9. The short rod 8 has a bore 10 extending lengthwise through it from one side of the link to the other side of the link, with a slot 11 of similar length which connects the bore 10 with the outside of the chain link. Advantageously bore 10 has a diameter corresponding to that of the long rod 9, while slot 11 is slightly narrower, thereby allowing elastic snapping of a successive rod 9 forming part of the next link of chain 1, into the bore 10. As is further shown in FIG. 2, chain link 1*a* has a pair of the aforementioned undercut keys (2) thereon. The keys are formed on the relatively widely spaced portions of the side walls 7 of the link, thereby providing stable as well as simple mounting of the toy blocks connected with the keys.

The new chain links and toy blocks can not only be formed in a simple injection molding process, as is usual for synthetic plastic material, but can also be used most effectively and successfully by the child, in the processes of assembly and using the complete toy. Particularly when the links 1*a* and blocks 3 are resilient, their interconnecting keys 2 and grooves 4 tend to retain and hold each other, once they have been properly assembled, thereby preventing any sliding off of toy blocks from chain 1. For example a toy full-tread vehicle using a chain 1 can be moved rapidly and repeatedly, even around curves of short radius, without any danger that treads 3 are lost by sliding off.

Referring to FIG. 3, it will be noted that a toy chain 22 can be formed with regular succession of chain elements 21*a* having connector keys 23 for connecting toy block 24 thereto. The chain elements 21*a* with keys 23 can be spaced relatively far—as shown, they are spaced by three plain chain links 21, without connecting keys 23— in order to accommodate a relatively great length of the chain 22 for each toy element or block 24, and for the operation thereof, for example when toy blocks 24 are buckets for water or other material to be received therein, transported thereby and discharged therefrom. For such purposes chain 22 can be trained over a pair of spaced sprockets, one of which is shown at 25. Each bucket 24 has a connecting groove 27 formed in at least one wall surface 26 of the bucket 24, for connection to keys 23 on the toy block connecting chain links 21*a*.

As shown in FIG. 4, the interconnection of toy buckets 24 with keys 23 can also be effected with the aid of a second groove 27 formed in a second wall surface 28 of the bucket, the wall surfaces 26 and 28 being arranged at an obtuse angle to one another. By this arrangement the toy teaches ways of utilizing the same types of chain elements 21, 21*a* and the same types of toy elements 24 for either horizontal transport of material such as water (FIG. 3) or for lifting of such a material (FIG. 4), thereby introducing the child into the concept of using standardized parts in the construction of machinery.

As shown in FIG. 5 one end of each groove 27 is preferably closed by an end wall 29, similar to the end walls 5 mentioned in connection with FIGS. 1 and 1*a*.

It will be understood that toy buckets 24 can be attached to chain 22 with the aid of grooves 27 formed in bucket walls 26 parallel to the top edges of the buckets 24 (FIG. 3), for carrying water and the like only after tilting the upper edge of the bucket 24 into substantially horizontal position. By contrast, when the same bucket 24 is attached to chain 22 by means of groove 27 in bucket end wall 28, at an obtuse angle to wall 26, it allows conveying water in vertical direction, as indicated at the left side of FIG. 4. The water then begins to be discharged as the bucket begins to move over the top sprocket 25 and is fully discharged when the bucket has moved past the top of the sprocket.

It will be understood that each of the elements described above, or two or more together, may also find a useful application in other types of toy differing from the types described above.

While the invention has been illustrated and described as embodied in a toy, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a toy, a combination comprising a plurality of chain elements pivotally connectable to each other, each of said chain elements being a link having wall means including first side wall portions at one end of said respective chain elements relatively close together and having second side wall portions at the other end more widely spaced apart, each chain element including a relatively short rod integrally interconnecting the relatively close first side wall portions and a relatively long rod integrally interconnecting the more widely spaced second side wall portions, means readily detachably connecting adjacent ones of said chain elements comprising a bore extending along and through the relatively short rod and a slot extending along and opening from said bore, said slot forming a restricted opening so as to allow snapping of the relatively long rod of a further chain element into engagement in said bore; a plurality of toy elements being toy buckets; and coacting means on each of said toy elements and on at least some of said chain elements for connecting such toy elements to such chain, said coacting means comprising undercut keys on some of said coacting-means-bearing elements and correspondingly shaped undercut grooves on others of said coacting-means-bearing elements, each of said toy buckets having several surfaces respectively provided with one of said coacting means for cooperation with the other coacting means on said chain, two of said surfaces being disposed at obtuse angles to one another.

2. A combination as defined in claim 1 wherein said keys are on less that all of said chain elements and said grooves are in all of said toy elements.

3. A combination as defined in claim 2 including, on one side of each toy element, an end wall extending across the corresponding end of a said groove.

4. A combination as defined in claim 1, wherein said toy buckets form a toy bucket chain.

5. A combination as defined in claim 1, wherein said coacting means on some of said chain elements are provided on said wall means.

6. A combination as defined in claim 5, wherein said wall means have said keys thereon, extending in the planes thereof.

7. A combination as defined in claim 6, wherein said keys extend from said relatively widely spaced second side wall portions.

8. A combination as defined in claim 1 wherein said elements consist of synthetic plastic material.

9. A combination as defined in claim 8, wherein said synthetic plastic material is resilient.

10. A combination as defined in claim 1, wherein said grooves are formed in said toy elements and have outwardly flaring ends to facilitate introduction of the interconnecting keys.

* * * * *